United States Patent [19]

Spiess et al.

[11] Patent Number: 5,056,955

[45] Date of Patent: Oct. 15, 1991

[54] LOCKING DEVICE FOR COVERINGS FOR MANHOLES AND OTHER GROUND OPENINGS

[75] Inventors: Hansruedi Spiess, Delemont; Francois Galvanetto, Alle, both of Switzerland

[73] Assignee: Von Roll AG, Gerlafingen, Switzerland

[21] Appl. No.: 513,012

[22] Filed: Apr. 23, 1990

Related U.S. Application Data

[63] Continuation of Ser. No. 276,097, Nov. 23, 1988, abandoned.

[30] Foreign Application Priority Data

Nov. 26, 1987 [CH] Switzerland ..... 4600/87

[51] Int. Cl.[5] ..... E02D 29/14

[52] U.S. Cl. ..... 404/25; 404/26; 292/91

[58] Field of Search ..... 404/25, 26; 292/19, 292/80, 85, 87, 91, 103, 327, DIG. 16, DIG. 38; 70/164, 168

[56] References Cited

U.S. PATENT DOCUMENTS

| | | | |
|---|---|---|---|
| 887,591 | 5/1908 | Cook | 404/25 |
| 897,046 | 8/1908 | Armstrong | 404/25 |
| 1,516,514 | 11/1924 | Tueckmantel | 292/103 |
| 2,133,789 | 10/1938 | Pool | 292/76 |
| 2,134,828 | 11/1938 | Kaplan | 292/76 |
| 2,693,100 | 11/1954 | Wiegel | 70/168 |
| 3,120,971 | 2/1964 | Bengtsson | 292/91 |
| 3,921,494 | 11/1975 | Coe | 404/25 |
| 4,075,796 | 2/1978 | Cuozzo | 404/26 |
| 4,254,647 | 3/1981 | Finck, Jr. | 70/164 |
| 4,354,298 | 10/1982 | Tanaka et al. | 292/327 |
| 4,544,191 | 10/1985 | Nakama | 292/87 |
| 4,592,579 | 6/1986 | Burnett | 292/327 |

*Primary Examiner*—Ramon S. Britts
*Assistant Examiner*—Gay Ann Spahn

[57] ABSTRACT

A locking device for a covering comprised of a frame and a cover includes arms, which are inserted in depressions or bores formed in the frame and/or cover, whereby they undergo elastic deformation and consequently form a frictional engagement with the cover. The free end each of the arms project beyond an inner flange of the frame and form there a positive connection between the arms and the inner flange. This results in a simple, but effective connection between the cover and the frame, without requiring machining of the arms or depressions.

20 Claims, 4 Drawing Sheets

Fig. 6
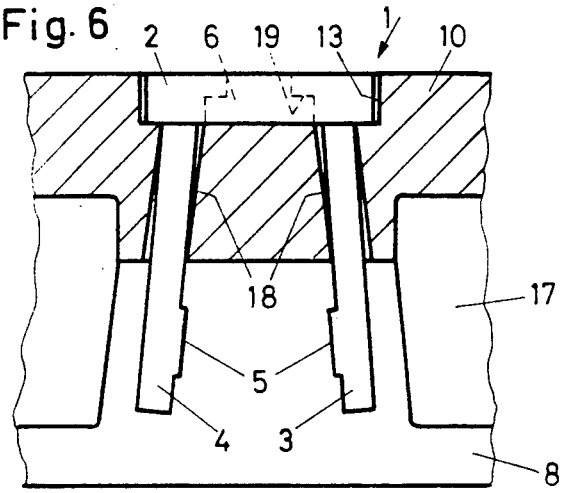
Fig. 7
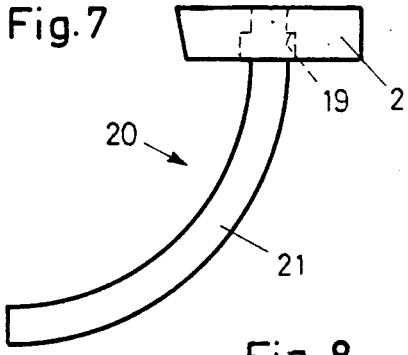
Fig. 8
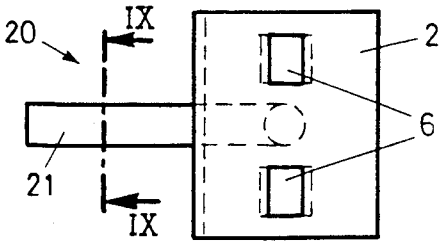
Fig. 9
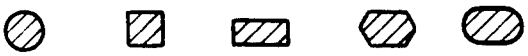
Fig. 10
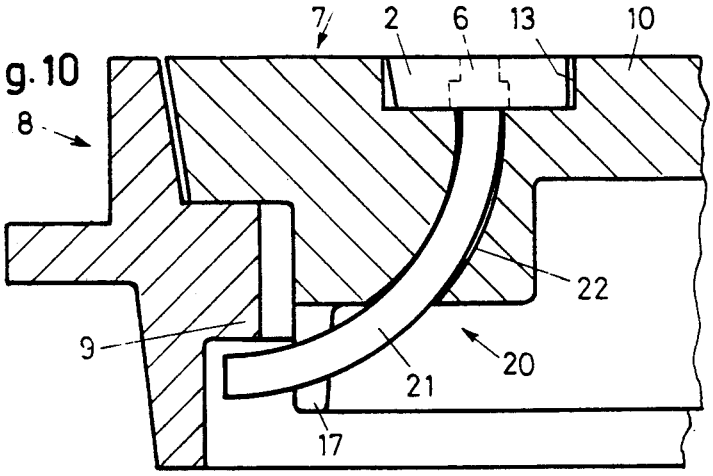
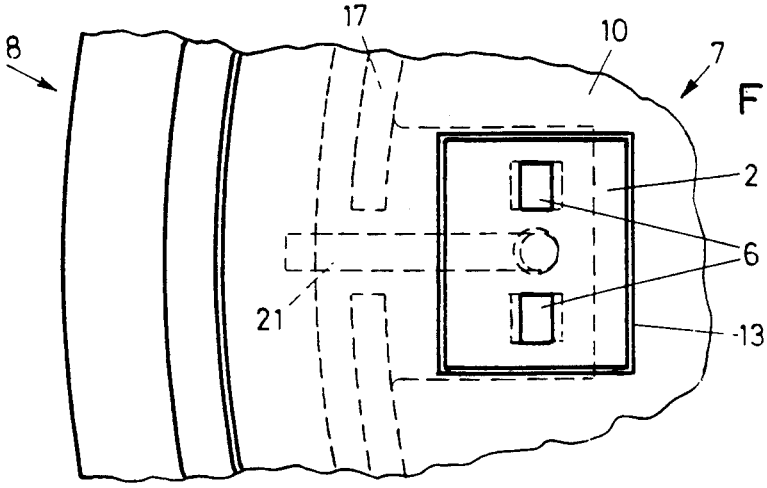
Fig. 11

LOCKING DEVICE FOR COVERINGS FOR MANHOLES AND OTHER GROUND OPENINGS

This is a continuation of application Ser. No. 276,097, filed Nov. 23, 1988, now abandoned.

BACKGROUND OF THE INVENTION

The present invention relates to a locking device for coverings used to cover manholes, shafts, wells and other ground openings, which are covered with a cover or grate, which is inserted in a frame and which can only be raised or opened after removing the locking device.

The present invention relates to coverings of differing shapes and types used for manholes in the ground and other openings in floors or ceilings. The coverings of the type under discussion more particularly apply to the floors used for covering rooms in buildings and in the open and which require openings serving as an entry and exit for persons or goods to be placed into or taken out of the areas covered by the coverings. Depending on the application of such coverings, it is desirable for the covers or grates for covering openings to be secured, i.e. so that they cannot be raised and removed without a very considerable expenditure of force.

SUMMARY OF THE INVENTION

It is an object of the present invention to provide a locking device for the coverings of manholes and the like ground openings so that they can be produced with relatively little work effort, whilst being easy to fit and remove, and, at the same time, providing a reliable securing of the cover or grate in the frame.

According to the invention this and other objects of the invention are attained by a lock provided with at least one arm or a number of arms, which are inserted in the cover or grate and are adapted to come into operative connection or engagement with the frame, whilst producing an elastic deformation in the arm or arms.

The invention also relates to a covering of a shaft or an opening provided in the floor or ground, which is constituted by a frame and a cover or grate inserted therein, the cover or grate being equipped with the locking device according to the invention and wherein a channel is provided in the cover or grate and/or in the frame for receiving at least one arm or a number of arms, and the shape of which differs from that of the external shape of the arm or a number of arms, in such a way that an elastic deformation is forced on the arm or arms during the fitting of the looking device.

The invention is described in greater detail hereinafter relative to non-limitative embodiments and the attached drawings.

BRIEF DESCRIPTION OF THE DRAWINGS

FIG. 6 is a section taken along line VI—VI of FIG. 5;

FIG. 7 is a side view of a second embodiment of the locking device with a single arm;

FIG. 8 is a plan view of the locking device according to FIG. 7;

FIG. 9 shows different variants of cross sectional profiles of the arm in a section taken along line IX—IX of FIG. 8;

FIG. 10 is a vertical sectional view through a shaft covering with the fitted locking device according to FIGS. 7 and 8;

FIG. 11 is a plan view of the shaft covering according to FIG. 10;

DETAILED DESCRIPTION OF THE PREFERRED EMBODIMENTS

Figure 1:
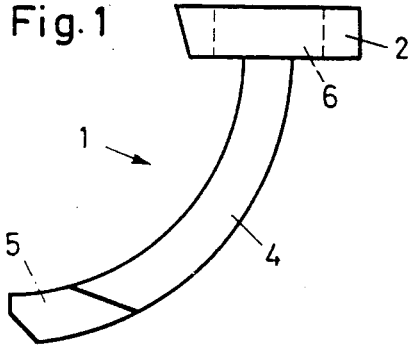
FIG. 1 is a side view of the locking device of a first embodiment of the invention.
Figure 2:
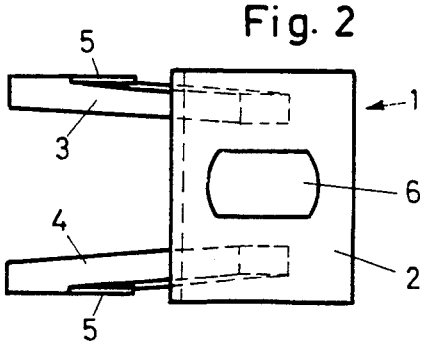
FIG. 2 is a plan view of the locking device according to FIG. 1.

Referring now to the drawings in detail, the locking device 1 shown in FIGS. 1 and 2 includes a retaining head 2. Two arms 3 and 4, which have a circularly bent form, project downwardly from head 2. In their reciprocal position with one another, the arms diverge or are directed away from each other instead of being parallel. At their free ends, arms 3, 4 have on their diverging surfaces projecting or outwardly extending surfaces 5, the function of which will be explained hereinafter. The retaining head 2 is substantially parallelepipedic, but can also be given any other suitable shape. Head 2 is centrally provided with a randomly shaped opening 6, which is used for inserting a tool, if the locking device 1 is to be opened.

Figure 3:
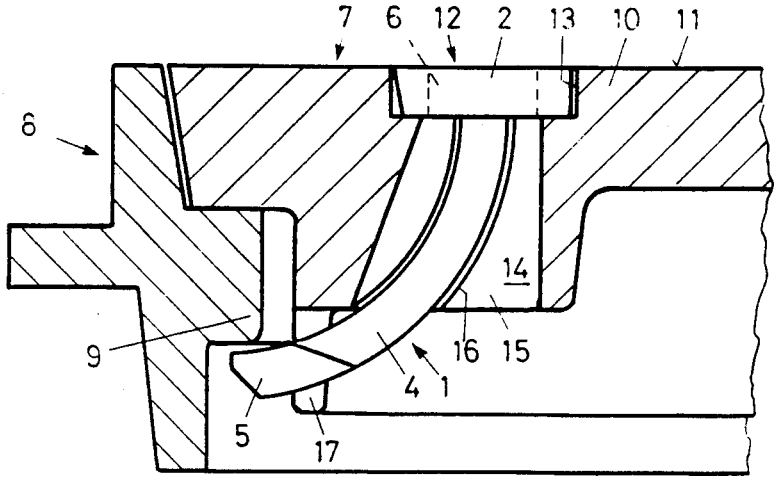
FIG. 3 is a vertical sectional view through the locking device of FIG. 1 fitted in a cover of a manhole covering.
Figure 4:
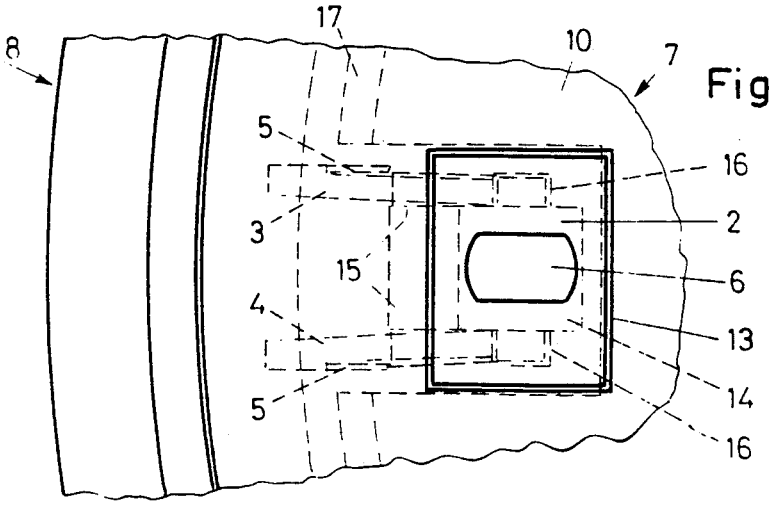
FIG. 4 is a plan view of the locking device of FIG. 3.

FIGS. 3 and 4 show the fitting of the locking device according to FIGS. 1 and 2 in a covering 7 of a manhole or some other opening. The covering has a frame 8 with an inner flange 9, on which is supported a cover 10. In place of the cover 10, it is possible to use a grate with the identical circumferential shape. The cover 10 has a passage 12, which has a widened recess 13 in the top of the cover 11 and is used for receiving the retaining head 2. Below the recess 13 is provided a widening channel 14, in the side walls 15 of which is formed a curved, channel-like depression 16. The depressions 16 extend parallel to one another.

Arms 3, 4 are inserted in depressions 16 and must be compressed as a result of their divergence from one another. This compression is at maximum in the vicinity of the projecting surface 5, because the distance between the two arms 3, 4 is at a maximum and this distance decreases the further arms 3, 4 are inserted in depressions 16. In the end position according to FIG. 3, the ends of arms 3, 4 project beneath the inner flange 9. The projecting surface 5 of each arm is located below cover 10 and serves as a holding-back means, so that on removing the cover the locking device 1 cannot drop out of the passage 12. On the underside of cover 10 is shaped a collar or projection 17, which is interrupted in the vicinity of the two arms 3, 4, so that the passage of arms 3, 4 is not impeded. Collar 17 prevents damage to arms 3, 4 on removing cover 10.

It is important that no complicated screwing means or other fastening is required for the fixture of the locking device 1. On the other hand, the locking device 1 is retained in the depressions 16 with a frictional engagement due to the compression of arms 3, 4. On the other hand, the engagement of arms 3, 4 beneath the inner flange 9 leads to a positive or form-locking connection between cover 10 and frame 8.

It is also important that the locking device 1 and passage 12 do not require machining. This applies to all the locking devices described here and the corresponding portions in frame 9 or cover 10. The parallelism of the depressions 16 is also not important. It is important that the arms 3, 4 undergo compression and are consequently held in cover 10 by frictional force. The cross-sectional profile of arms 3, 4 is appropriately rectangular here. On dismantling the locking device 1, it is necessary to compress arms 3, 4 so that the projecting surface 5 does not strike against the base of depression 16.

Figure 5:
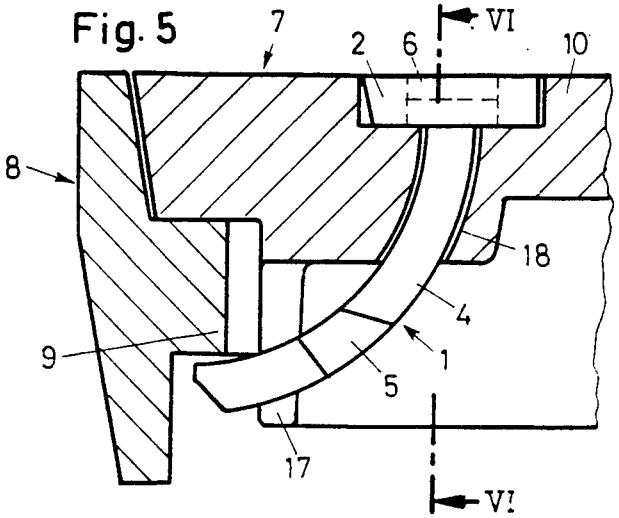
FIG. 5 is a vertical sectional view similar to that of FIG. 3 of the embodiment of the locking device fitted in the cover of a manhole covering.

FIGS. 5 and 6 show a similar arrangement to that of FIG. 3 and 4. The difference is that the arms 3, 4 of the locking device 1 are not roughly parallel to one another in the fitted state but are instead spread apart during fitting, cf. FIG. 6. For this purpose closed bores 18 are provided in place of the depressions 16. A further difference is that the projecting surfaces 5 are now arranged on the sides of arms 3, 4 directed towards one another. It is further indicated in FIG. 6 that the opening 6 in retaining head 2 has a stepped part 19 under which the tool can be applied for opening the locking device 1. The same reference numerals are used in FIGS. 5 and 6 for the same parts as in FIGS. 3 and 4.

FIGS. 7 and 8 show a locking device 20 of the third embodiment. Locking device 20 differs from device 1 in that it has only a single curved arm 21, whereof a few cross-sectional profiles are possible as visible in FIG. 9. A further difference is that there are two openings 6 on either side of arm 21, which openings are also used for the disassembly of the locking device 20.

FIGS. 10 and 11 show the fitting of the locking device according to FIGS. 7 and 8 in covering 7. In the cover 10 of the covering 7 there is only a single bore 22 projecting from extension 13, and arm 21 of locking device 20 is inserted in bore 22. As can be gathered from FIG. 10, the radius of curvature of bore 22 is smaller than that of arm 21. As a result the arm is elastically deformed in bore 22 and is held by means of a frictional force or connection. The free end of arm 21 projects beneath the inner flange 9 of frame 8.

Figure 12:
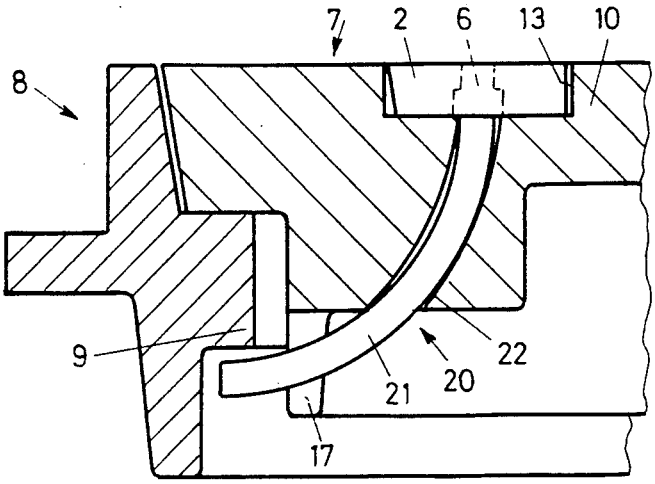
FIG. 12 is a vertical section through a manhole covering with the fitted locking device according to FIGS. 7 and 8, but with an insertion channel for the locking device differing from that of FIG. 10.

FIG. 12 shows the same locking device 20 as that of FIGS. 10 and 11, but channel 22 is constructed with a larger radius of curvature than that of arm 21. This also results in elastic deformation of arm 21 and consequently frictional engagement takes place between arm 21 and the wall of bore 22. As in the preceding locking devices, the free end of arm 21 projects beyond the frame 8 and forms a positive or form-locking connection with cover 10.

Figure 13:
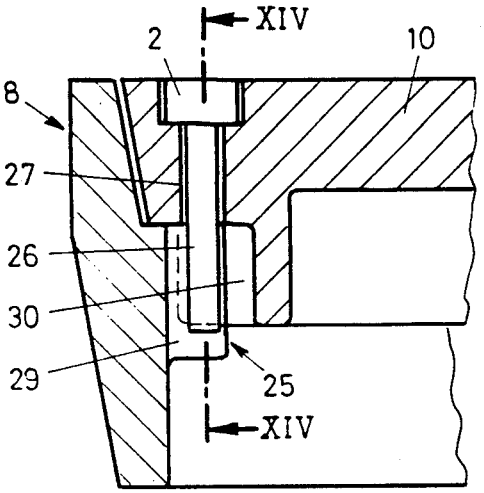
FIG. 13 is a vertical sectional view through a shaft covering with a fitted locking device according to a further embodiment.
Figure 14:
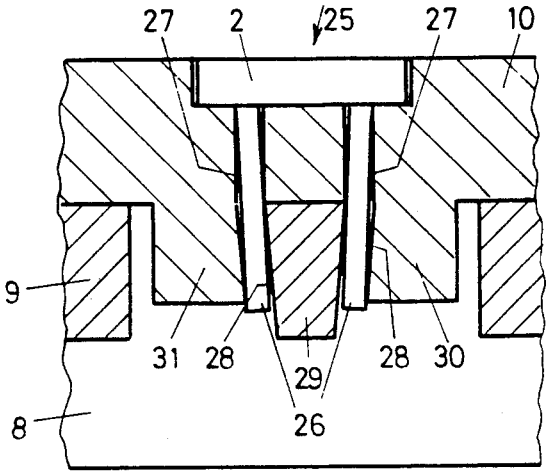
FIG. 14 is a sectional view taken along line XIV—XIV of FIG. 13.
Figure 15:
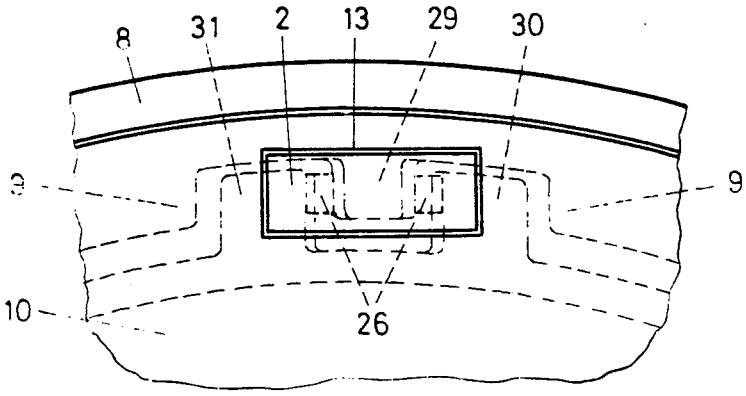
FIG. 15 is a plan view of the shaft covering assembly according to FIG. 13.

FIGS. 13, 14 and 15 show a fourth embodiment of the locking device designated at 25, which is constructed with two substantially straight arms 26. In cover 10 are formed bores 27, whilst in the frame 8 are provided depressions 28, which have a direction diverging from that of the bores 27. As can be gathered from FIG. 14, the depressions 28 are inclined relative to one another. If the locking device 25 is now inserted within the depressions 28, frictional engagement occurs between arms 26 and the walls of depressions 28. Thus, cover 10 is held by frictional lock or engagement in frame 8. In order that the depressions 28 can be provided in frame 8, the inner flange 9 of frame 8 is constructed at this point in a different way, so that an interrupted portion 29 forms, which cooperates with interrupted portions 30, 31 of the cover or grate 10. It is now easy to see that the cover 10 or grate can be raised, but not removed without opening the locking device 1, because at the upper end of the depressions 28, there is a reduction of the free passage of the depressions through lower portions 30, 31 of cover or grate 10 and therefore there is a jamming of the arm 26. This means that, apart from the frictional engagement, there is a blocking of the cover or grate 10.

Figure 16:
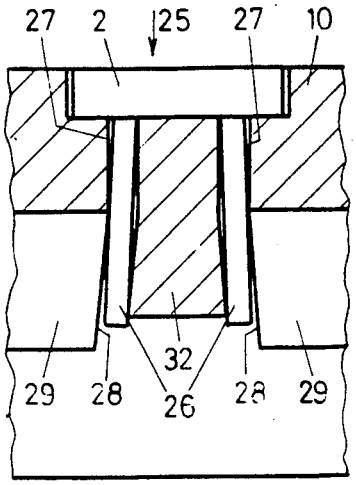
FIG. 16 is a section similar to that of FIG. 14 but illustrating the locking device of yet another embodiment with channels differing from those of FIG. 13 for receiving the arms of the locking device.

In FIG. 16, the difference, as compared with the embodiment of FIGS. 13 to 15, is that the depressions 28 diverge from each other. The frictional engagement between arms 26 and depressions 28 occurs due to elastic deformation of the arms 26. Here again there is a locking of the cover 10 or grate as in FIG. 16, so that without opening the locking device 1, the cover or grate can only be raised, but not removed.

Figure 17:
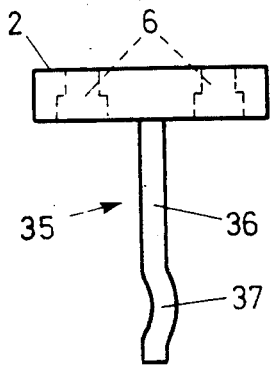
FIG. 17 is a side view of still another embodiment of the locking device.
Figure 18:
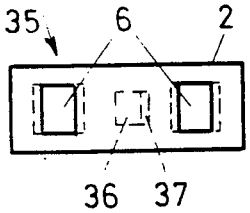
FIG. 18 is a plan view of the locking device according to FIG. 17.

FIGS. 17 and 18 show yet another embodiment of the locking device denoted at 35. A straight arm 36, which has a curved portion 37, is fixed to the retaining head 2.

Figure 19:
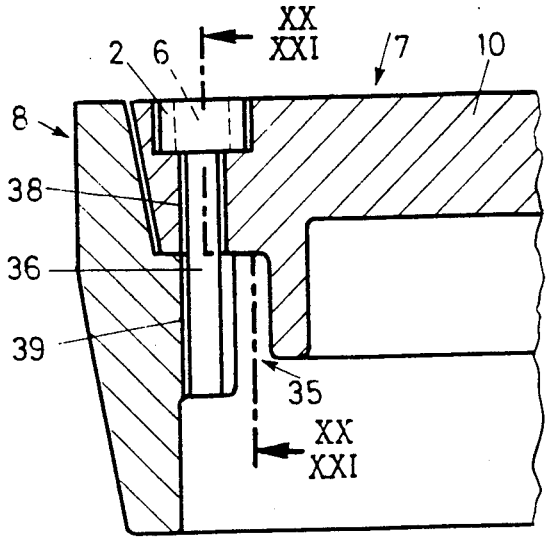
FIG. 19 is a vertical sectional view through a shaft covering with a fitted locking device of FIGS. 17 and 18.
Figure 20:
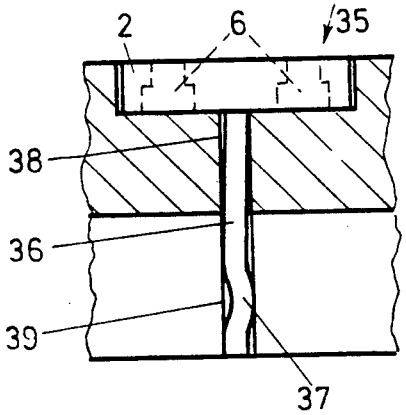
FIG. 20 is a sectional view taken along line XX—XX in FIG. 19.
Figure 21:
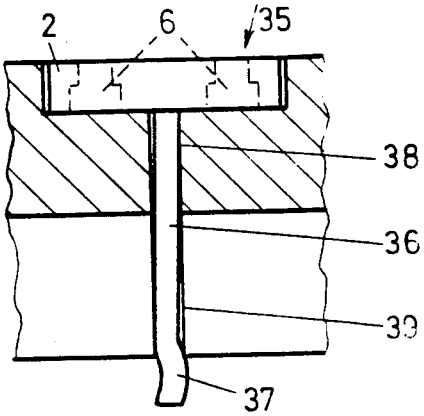
FIG. 21 is a sectional view taken along line XXI—XXI in FIG. 19, in which the locking device is provided with a longer arm than that of FIG. 20.

FIGS. 19, 20 and 21 show the locking device 35 in the fitted state. In cover 10 is provided a bore 38, to which is connected a depression 39 formed in frame 8 and substantially aligned with bore 38. The frictional engagement is produced by the curved portion 37 and the side walls of depression 39.

FIG. 21 shows the same locking device 35, but in this case the arm 36 is longer than in FIG. 20, so that the curved portion 37 projects outwardly from depression 39, so that there is a positive or form-locking engagement rather than a frictional engagement.

Figure 22:
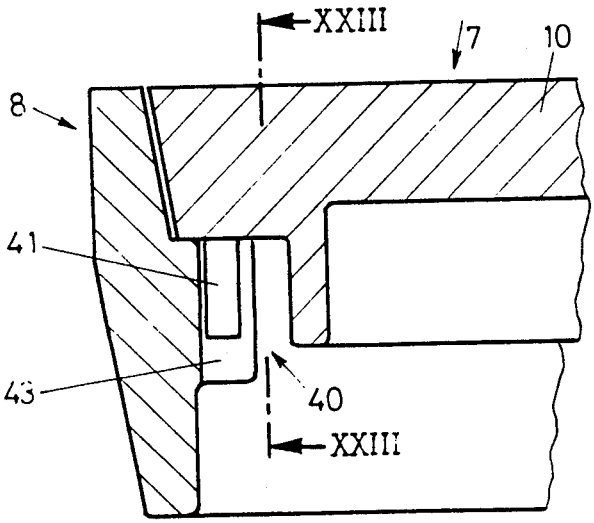
FIG. 22 is a vertical sectional view through a manhole covering with a locking device integrally connected to the manhole cover, in accordance with yet another embodiment.
Figure 23:
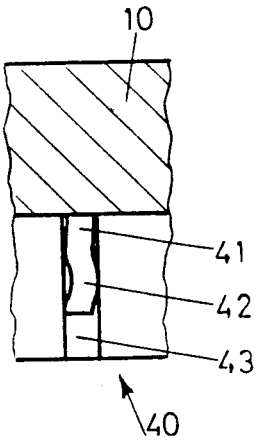
FIG. 23 is a section taken along line XXIII—XXIII in FIG. 22.

FIGS. 22 and 23 show yet a further embodiment of the locking device designated at 40, which also has a single arm 41, which has a curved portion 42. The difference as compared with the locking device 35 is that the arm 41 is fixed to cover 10. It can in fact be an integral part of cover 10. Thus, the frictional engagement takes place between the walls of depression 43 provided in frame 8 and the curved portion 42 of arm 41 arranged in cover 10. Here again, as in FIG. 21, the arm 21 may be longer and project at the bottom out of depression 43.

The described locking devices 1, 20, 25, 35 and 40 can be made from steel, ductile cast iron or plastic. The same materials can also be used for the manufacture of the parts of the covering 7, i.e. the cover or grate 10 and the frame 8. The materials must be elastically deformable to such an extent that they withstand deformations during fitting and in the fitted state.

While the foregoing description represents preferred embodiments of the present invention, it will be obvious to those skilled in the art that various changes and modifications may be made, without departing from the spirit and scope of the present invention.

What is claimed is:

1. Covering for a manhole provided in the floor or ground, comprising a frame having an inwardly radially extending flange, a cover inserted in said frame and being supported on said flange; a one-piece locking device for locking said cover to said frame, said one-piece locking device including a retaining head inserted in said cover and at least one elastically deformable locking arm rigidly connected to said retaining head and extending from said cover downwardly towards said frame; and at least one passage means provided in at least said cover, said locking arm extending through said passage means and including at least a portion which extends in a direction differing from a direction of extension of at least a portion of said passage means so that said locking arm is elastically deformed when inserted into said passage means whereby said locking device is retained in said cover in a locking position thereof.

2. Covering according to claim 1, wherein said retaining head is shaped and is formed with at least one opening for receiving a tool for releasing said locking device.

3. Covering according to claim 1, wherein two said locking arms are provided and said passage means include two passages formed in said cover and receiving two respective locking arms therein.

4. Covering according to claim 1, wherein said cover includes a recess receiving said retaining head.

5. Covering according to claim 1, wherein said passage means includes at least one depression formed in said cover.

6. Covering according to claim 1, wherein said passage means includes at least one bore formed in said cover.

7. Covering for a manhole provided in the floor or ground, comprising a frame having an inwardly radially extending flange; a cover inserted in said frame and being supported on said flange; a one-piece locking device for locking said cover to said frame, said one-piece locking device including a retaining head positioned in said cover and at least one elastically deformable locking arm rigidly connected to said retaining head and extending from said cover, downwardly towards said frame; and at least one passage means provided in least said cover, said locking arm extending through said passage means and including at least a portion which extends in a direction differing from a direction of extension of at least a portion of said passage means so that said locking arm is elastically deformed when inserted into said passage means whereby said locking device is retained in said cover in a locking position thereof, said locking arm being curved and projecting downwardly below said flange, said passage means being formed in said cover and being curved in correspondence with said locking arm, said locking arm engaging said inner flange in a locked position of the cover with the frame.

8. Covering according to claim 7, wherein said at least one locking arm is provided with a laterally outwardly protruding surface for preventing unintentional removal of said locking device from said cover.

9. Covering for a manhole provided in the floor or ground, comprising a frame having an inwardly radially extending flange; a cover removably inserted in said frame and being supported on said flange; a one-piece locking device for locking said cover to said frame, said one-piece locking device including a retaining head inserted in said cover and at least one elastically deformable locking arm rigidly connected to said retaining head and extending from said cover downwardly towards said frame; and at least one passage means provided in at least said cover, said locking arm extending through said passage means and including at least a portion which extends in a direction differing from a direction of extension of at least a portion of said passage means so that said locking arm is elastically deformed when inserted into said passage means, whereby said locking device is retained in said cover in a locking position thereof, said locking arm being a straight arm, said passage means being also straight, said locking arm engaging said flange in a friction-locking manner.

10. Covering according to claim 9, wherein two said locking arms are provided and said passage means include two passages formed in said cover and receiving two respective locking arms therein.

11. Covering according to claim 9, wherein said passage means includes a bore formed in said cover.

12. Covering according to claim 9, wherein said passage means includes at least one depression provided in said frame.

13. Covering according to claim 9, wherein said retaining head is shaped, said cover being provided with a recess receiving said retaining head.

14. Covering for a manhole provided in the floor or ground, comprising a frame having an inwardly radially extending flange; a cover inserted in said frame and being supported on said flange; a one-piece locking device for locking said cover to said frame, said one-piece locking device including a retaining head inserted in said cover and at least one elastically deformable locking arm rigidly connected to said retaining head and extending from said cover downwardly towards said frame; and at least one passage means provided in at least said cover, said locking arm extending through said passage means and including at least a portion which extends in a direction differing from a direction of extension of at least a portion of said passage means so that said locking arm is elastically deformed when inserted into said passage means whereby said locking device is retained in said cover in a locking position thereof, said locking arm being straight over a substantial part thereof and having a curved portion, said passage means being formed also in said flange and having a configuration differing from that of said curved portion of said locking arm so that an elastic deformation is produced when said curved portion is inserted into said passage means.

15. Covering according to claim 14, where said cover has a recess receiving said retaining head.

16. Covering according to claim 14, wherein said passage means includes a bore extending through said cover and also said flange.

17. Covering according to claim 14, wherein said curved portion is formed at an end of said locking arm and partially extends outwardly of said flange so as to engage with an edge thereof.

18. Covering for a manhole provided in the floor or ground, comprising a frame having an inwardly radially extending flange; a cover inserted in said frame and being supported on said flange; a one-piece locking device for locking said cover to said frame, said one-piece locking device including at least one elastically deformable locking arm rigidly connected to said cover and extending from said cover downwardly towards said frame; and at least one passage means provided in said flange, said locking arm extending through said passage means and including at least a portion which extends in a direction differing from a direction of extension of at least a portion of said passage means so that said locking arm is elastically deformed when inserted into said passage means whereby said locking device is retained in said cover in a locking position thereof, said locking arm being straight over a substantial part thereof and having a curved portion, said passage means having a configuration different from that of said curved portion so that an elastic deformation of said locking arm is produced when said curved portion is inserted into said passage means.

19. Covering according to claim 18, wherein said locking arm is integral with said cover.

20. Covering according to claim 18, wherein said passage means includes a depression formed in an inner wall of said flange.

* * * * *